US005992641A

United States Patent [19]

Caldwell, Jr.

[11] Patent Number: 5,992,641

[45] **Date of Patent: *Nov. 30, 1999**

[54] METHODS AND APPARATUS FOR SCREENING PARTICULATE MATERIALS

[75] Inventor: Ronald W. Caldwell, Jr., Milledgeville, Ga.

[73] Assignee: ECC International Inc., Roswell, Ga.

[ * ] Notice: This patent is subject to a terminal disclaimer.

[21] Appl. No.: 08/462,620

[22] Filed: Jun. 5, 1995

[51] Int. Cl.[6] ..... B07B 1/04

[52] U.S. Cl. ..... 209/273; 209/380

[58] Field of Search ..... 209/380, 268, 209/269, 273, 367, 366.5, 366

[56] References Cited

U.S. PATENT DOCUMENTS

| | | | |
|---|---|---|---|
| 843,185 | 2/1907 | Thom | 209/380 X |
| 2,904,267 | 9/1959 | Lyons . | |
| 3,007,575 | 11/1961 | Sylvest | 209/380 X |
| 3,014,836 | 12/1961 | Proctor . | |
| 3,326,705 | 6/1967 | Duke et al. . | |
| 3,477,572 | 11/1969 | McKibben | 209/380 X |
| 3,586,523 | 6/1971 | Fanselow et al. . | |
| 3,594,203 | 7/1971 | Sawyer et al. . | |
| 3,754,712 | 8/1973 | Cecil . | |
| 3,846,147 | 11/1974 | Tapper . | |
| 3,853,983 | 12/1974 | Abercrombie, Jr. et al. . | |
| 4,018,673 | 4/1977 | Hughes et al. . | |
| 4,130,478 | 12/1978 | Swallow | 209/380 X |
| 4,246,039 | 1/1981 | Mixon, Jr. et al. . | |
| 4,381,948 | 5/1983 | McConnell et al. . | |
| 4,613,432 | 9/1986 | Racine et al. | 209/269 X |
| 4,687,546 | 8/1987 | Willis . | |
| 4,818,294 | 4/1989 | Raythatha . | |
| 5,051,166 | 9/1991 | Heimhard et al. | 209/380 X |
| 5,122,262 | 6/1992 | Summers | 209/380 X |
| 5,124,029 | 6/1992 | Fjallstrom et al. | 209/380 X |
| 5,171,725 | 12/1992 | Wright et al. . | |
| 5,259,955 | 11/1993 | Bolton | 209/380 X |

*Primary Examiner*—David H. Bollinger
*Attorney, Agent, or Firm*—Suzanne Kikel

[57] ABSTRACT

Improved methods of screening particulate matter are disclosed. For example, aqueous mineral slurries containing at least 10 weight percent of finely divided mineral solids are mechanically size separated using vibratory screening and a self propelled recirculative rotating spray bar, prior to, and subsequent to various processing steps. The employment of the spray bar improves the screening process by preventing blinding of the screen, as well as increasing throughput. As a result this invention reduces screen residues and/or increases production rates significantly.

38 Claims, 6 Drawing Sheets

METHODS AND APPARATUS FOR SCREENING PARTICULATE MATERIALS

BACKGROUND OF THE INVENTION

This invention pertains to processes for screening finely divided aqueous mineral slurries comprising 10 percent or more by weight of solids, such as kaolin clays, calcium carbonate, calcium sulfate and other finely divided minerals, in order to reduce screen residue or otherwise mechanically size and separate the slurries' constituents. Such products are useful as fillers and coatings for paper, as well as other specialty applications such as, in paints, plastics, rubber products, etc.

Kaolinite occurs naturally as clay, which is mined and processed to produce kaolin pigments for use, e.g., in paper filling and paper coating applications. In general, the objectives of using a kaolin pigment are to improve qualities of the paper product, such as opacity, brightness, smoothness, printing, porosity, surface coverage, light scatter, and to reduce the cost of paper manufacturing. Various methods are commonly employed to enhance the performance of a given kaolin pigment. Among these are calcining and chemical aggregating methods which improve the brightness and opacity imparted to paper by a given kaolin pigment.

Aside from use as fillers, the aggregated pigments are used in paper coating to improve surface coverage. The application of such pigments can lead to a smoother surface, higher porosity, gloss and print properties. In Raythatha, U.S. Pat. No. 4,818,294 a chemically aggregated kaolin pigment is shown to significantly increase coated sheet properties, especially paper and print gloss.

In more detail, in U.S. Pat. No. 4,381,948 to McConnell et al., a calcined kaolin pigment and a method for manufacture of same are disclosed. The said pigment consists of porous aggregates of kaolin platelets, and exhibits exceptionally high light scattering characteristics when incorporated as a filler in paper. This pigment, which substantially corresponds to the commercially available product ALPHATEX® of the present assignee, ECC International Inc. (Atlanta, Ga.), is prepared by first blunging and dispersing an appropriate crude kaolin to form an aqueous dispersion of same. The blunged and dispersed aqueous slurry is subjected to a particle size separation from which there is recovered a slurry of the clay, which includes a very fine particle size; e.g. substantially all particles can be smaller than 1 micrometer E.S.D. The slurry is dried to produce a relatively moisture-free clay, which is then thoroughly pulverized to break up agglomerates. This material is then used as a feed to a calciner; such feed is calcined under carefully controlled conditions to typical temperatures of at least 900° C. The resulting product is cooled and pulverized to provide a pigment of the porous high light scattering aggregates of kaolin platelets as described.

Calcined kaolin products, including those of the aforementioned ALPHATEX® type, are seen to be manufactured by relatively complex techniques involving a multiplicity of steps, including specifically a calcining step, plus various preparatory steps and post-calcining steps. Thus, the said product is relatively expensive to produce, and requires considerable investment in complex apparatus and the like; e.g. highly regulated calciners, etc. The particle size in the feed to the calciner must be carefully controlled, because a relatively small increase in coarseness of such feed can have very marked detrimental effect on abrasion. Furthermore, calcination per se will produce an abrasive product if overheating occurs. Consequently, the conditions of preparation of calcined materials must be very carefully controlled in order to keep abrasion acceptably low in the calcined product.

Many types of processes are used to prepare kaolin clay and the like for various industrial uses. For example, U.S. Pat. No. 3,594,203 discloses high solids slurries of kaolin clay coating pigments obtained by the flotation of colored impurities from sedimentary Georgia kaolin clay. U.S. Pat. No. 3,853,983 discloses a process for removing discoloring contaminants containing iron and sulfur from crude kaolin clays by roasting and slurrying the clay and subjecting it to a magnetic field. U.S. Pat. No. 4,246,039 discloses processes of treating kaolin clay via wet scrubbers, spray dryers and the like to provide a dry clay feed to a calciner. U.S. Pat. No. 5,171,725 discloses the processing of heated kaolin slurries in high shear, high energy mixing devices. U.S. Pat. No. 3,326,705 discloses methods of reducing the viscosity of kaolin clay slurries by treatment with hydrofluoric acid and mechanical working. U.S. Pat. No. 3,754,712 discloses methods of stabilizing slurries of calcined kaolin clay by wet-milling. U.S. Pat. No. 4,018,673 discloses centrifugal methods of separating coarse materials and chemical and mineral impurities from crude clay slurries. U.S. Pat. No. 2,904,267 discloses extrusion processes for reducing coarse particles of kaolin clay in size. U.S. Pat. No. 4,687,546 discloses processes of concentrating beneficiated kaolin clay slurries by evaporation in heat exchangers.

This invention relates to an improved process for screening aqueous mineral slurries containing 10 weight percent or more of mineral, thus providing improved screen residues and production rates. More particularly, this invention relates to the preferred use of a self propelled recirculative rotating spray bar for screening finely divided minerals such as kaolin clay, calcium carbonate, calcium sulfate and similar mineral slurries prior to shipment. The instant invention provides mechanisms associated with liquid properties that prevent screen blinding and flooding. Screen blinding greatly limits mesh sizes and production rates and leads to process disturbances such as flooding and raw material waste. This invention allows screening through a finer mesh, much improved reject material ejection, and increased production rates.

Currently, aqueous mineral slurries containing at least 10 percent by weight of finely divided mineral solids are mechanically size separated using state-of-the-art vibratory screening. Screening is performed prior to magnetic separation, bleaching, ozonation, flotation, calcination, filtration, and shipping, and screened subsequent to such processes as degritting, centrifugal separation, and delamination, to mention a few. The primary purpose of screening is to separate undesirable constituents and to achieve a very low percentage of screen residue. Residue is an important physical property and low residues are critical for the performance of kaolin in the paper industry. Screening is accomplished using a uniform pattern of apertures in which oversize material is retained on the surface and undersize material passes through. In kaolin slurries, the oversize constituent is generally considered undesirable, containing mostly mica, silica, quartz, feldspar, agglomerates of tightly bonded clay and common indigenous minerals. Ideally, these reject materials are ejected from the surfaces of vibratory screens which use various aperture sizes at progressive stages during processing. However, due to the nature of finely divided mineral slurries, insufficient ejection of the rejects is commonplace and screen blinding regularly occurs. Consequently, mesh sizes, low screen residues, and production rates are limited, and raw material waste, bleach chemical waste, and inefficient processing result.

It is generally accepted in the art that the screening of aqueous pigment slurries will result in blinded screens, inefficient screening and subsequent process disturbances. The current practice is to periodically rinse the surface of the screens from above, i.e. from the same side as the feed stream, with water, either manually or automatically. This practice has several undesirable effects. First, since the screen's surface is rinsed from the top, some of the rejects that have blinded the screen are forced through the apertures, thus increasing the residue present in the clay product. Second, since the screen is being rinsed with water, water is being introduced into the product stream, thus diluting the solids content from desired process standards. Third, as the product tank's level control senses the increased level from the added water, feed rates are decreased, causing not only a production disturbance but also improper bleaching. Fourth, since the current art uses a predominantly manual rinsing method, operators are required to periodically perform this operation, and this requires manpower. Fifth, if the screens blind and flood before the operators rinse them, which frequently occurs, then substantial amounts of feed can be lost via the reject spout. Sixth, as the screen is being rinsed, feed is carried to the reject spout with the rejects and rinse water. Seventh, because of the constant build up of rejects on the surface of the screen, screen life can be greatly reduced.

A variety of "anti-blinding" attachments are available for commercial screening machines. For example, the line of Minox Tumbler Screening Machines (Elcan Industries, Inc., New Rochelle, N.Y.) offers anti-blinding attachments including roller brush cleaning systems mounted below the screen deck, air cleaning systems with nozzles mounted on motor-driven arms below the screen to "blow the mesh clean and keep material moving", combined air and brush cleaning systems, "bouncing ball" cleaning systems having abrasion resistant spheres on the upper surface of the screen which are designed to keep the screen clear by freeing wedged particles, and straining attachments placed above the screen to break up large pieces and help to pass material through the screen. Air cleaning systems are only suitable in dry screening applications.

An object of the present invention is to provide improved methods for the separation of coarser materials from particulate industrial materials, particularly mineral feedstocks such as kaolin clays and the like. Another object of the invention is to provide greater yields of finely-divided clays and the like together with less waste of the feedstock. A further object of the invention is to provide improved mechanical screening processes for clays and the like, which processes can be operated on a substantially continuous basis for extended periods of time without blinding or other blockage of the screens employed.

The drawbacks of the current art are absent from this invention because the screen is being rinsed from below the screen surface, the spray bar or other spray means preferably uses recirculative screened slip, the products are produced at a constant rate, the spray bar is preferably self propelled, the spray prevents screen blinding and increases production rates, and the spray bar does not allow build-up. One skilled in the art will recognize that these results are very desirable for their process and product improvement values.

SUMMARY OF THE INVENTION

In accordance with the present invention, improved methods of screening liquid slurries of particulate matter are provided, comprising steps of:

(a) directing such slurries into screening means which pass a filtrate to a vessel and retain a residue; and (b) directing a plurality of streams of a fluid against the underside of the screening means to dislodge residue from the screens and improve the screening process.

The screening means are preferably conventional vibratory screening apparatus, but can be any suitable screening apparatus. The streams of fluid can be directed onto the screens of the screening means from a plurality of stationary nozzle means, which can be affixed to the walls of the vessel receiving the filtrate or can, e.g. be contained in a toroidal manifold concentric within such a vessel.

Preferably, the streams of fluid are directed through nozzle means in a spray bar mounted and adapted to rotate about the center of the receiving vessel. The spray bar can be rotated by manual or power rotation means, but preferably the nozzles therein are so directed as to provide sufficient impulse when the fluid is pumped through the spray bar and associated nozzles as to rotate the spray bar while at the same time directing streams of fluid against the underside of the screens. The fluid(s) employed for clearing the screens can comprise the filtrate and/or water. Preferably, due to the advantages described elsewhere, the fluid is liquid water and/or a recirculated filtrate from the receiving vessel. Suitable pumping means are provided for passing the fluids through the appropriate nozzles; alternatively, if the filtrate can be stored at a height above the screening apparatus so as to provide sufficient head, hydrostatic pressure can be used to effect such flow.

The slurries presently exemplified are aqueous slurries of mineral matter, but non-aqueous or mixed fluids may be used as well. Similarly, any particulate matter which is to be handled as a slurry and size-separated can be advantageously processed by such methods. For example, the particulate mineral matter can be paper fillers or coatings selected from clays, calcium carbonate and calcium sulfate; various ground mineral ores; ceramic materials; chemicals, fertilizers and various pigments. Aqueous or non-aqueous slurries of various foodstuffs and starch or protein-based industrial materials can also benefit from the methods of the invention. Particles of polymeric material such as polymer pellets for molding, storage or other uses can also be processed.

Apparatus of the invention suitable for carrying on such processes comprises suitable means for directing the slurries into screening means; screening means comprising reservoir means for the slurry and at least one screen which passes a filtrate of the slurry and retains a residue; means for directing a plurality of streams of a fluid against the underside of at least one screen to dislodge residue from the screen and improve the screening process; and vessel means for accumulating and recovering the filtrate of the slurry. Suitable pumps or other transfer means are provided to transfer these slurries and fluids from one component of the apparatus to the others.

As described above for the methods of the invention, the screening means preferably include vibratory means to facilitate rapid size separation of the particulate matter. Streams of fluid, which can be taken from the filtrate or from outside sources, can be directed onto the screening means from a plurality of stationary nozzle means, which can be mounted on the walls of the receiving vessel or contained in a manifold structure arranged within the vessel, such as a toroidal manifold concentric within a round vessel. Preferably, the nozzle means are contained in at least one spray bar mounted and adapted to rotate below the screening means, preferably about the center of the receiving vessel.

Such spray bars may be rotated by manual or power rotation means, but preferably are configured as self-rotating recirculating spray bars—that is, the nozzles in the spray bar are so directed as to provide sufficient impulse when the fluid is pumped through the spray bar as to rotate the spray bar while at the same time directing the streams of fluid against the underside of the screen(s). The spray nozzles are preferably directed at an adjustable acute angle from the vertical to provide a horizontal impulse for rotating the spray bar and a vertical spray component impinging the bottom of the screening means. The angle can be adjusted by rotating the arms of the spray bar, or any other suitable means. Although the simplest spray bars rotate about the center to provide two spray arms, plural arms can be joined at the center to provide for four or more arms in a single spray bar unit. Suitable pumps and other transfer means are provided to transfer the slurries and/or other fluids between the components of the apparatus.

While the invention will be illustrated using a single spray bar rotating at the center of a circular vibratory separator, the screening means and vessels can be rectangular, hexagonal or any suitable shape, and multiple spray means can be emplaced therein. As an alternative to the spray bars described, the spray means can comprise a horizontal drum rotating about a horizontal axis containing a plurality of nozzles arranged on the circumference thereof and directed at an acute angle from the radii of the drum to provide impulse for the rotation of the drum and spray the underside of the screening means.

This invention preferably employs a rotating spray bar which enhances the screening of aqueous pigment, clay or mineral slurries containing 10 weight percent or more pigment, wherein the screening mineral will have decreased screen residues and/or be produced at an increased rate. The spray bar of the instant invention permits the use of finer meshed screens at either current or increased production rates and with slurries containing very large amounts of undesirable constituents, the spray bar yields increased production rates at current mesh sizes.

Some of the main advantages of the preferred spray bar design are that the unit is self-propelled, requires no satellite support system such as an air compressor, is easy to clean, is relatively inexpensive to retrofit, uses only one moving part, and uses readily available parts and material. Its nozzles do not require extremely close positioning from the screen, it employs a noncomplex design, and it uses an existing screened product pump as the driving force, thus requiring no additional power consumption. Other advantages related to production and processing are that the unit has the ability to screen products through a finer mesh screen, at current or increased production rates, significantly reducing product residues and potentially allowing increased selling prices; it has the potential for producing new grades of clay, possibly after the sandgrinders; it could all but eliminate blinding and subsequent loss of feed and the continuous washing off of the screens by the operators, and it allows unique routine and special request screening capabilities.

These and other objects and advantages of the invention will be apparent from perusal of the following detailed description, including the drawings and appended claims. The term "and/or" is used in the usual sense, meaning one or both of the named items.

DETAILED DESCRIPTION OF THE INVENTION

Figure 1:
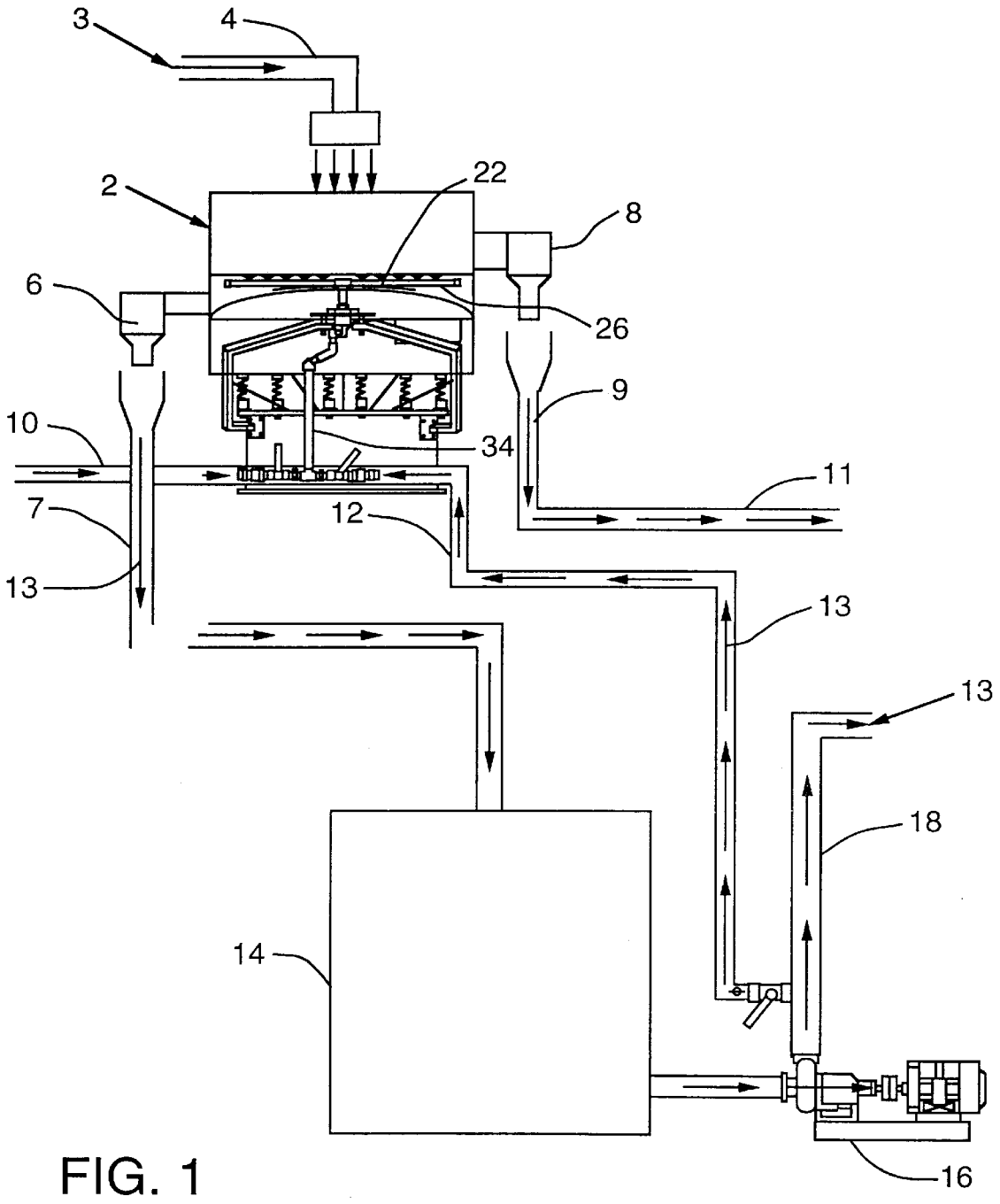
FIG. 1 is a process flow diagram illustrating a vibratory screen separator incorporating the present invention.

Turning now to the drawings, FIG. 1 is a process flow diagram illustrating a circular vibratory separator incorporating the present invention. A circular vibratory separator (2) receives feed (3) for the screen (22) from feed line (4), discharging reject material (9) through funnel (8) and line (11) which is directed to a reject pond. The filtrate product (13) is discharged via funnel (6) and line (7) to a surge tank (14). Plant water can be introduced through line (10) for supplemental washing and cleaning of the spray bar (26). Pump (16) is used to pump product (13) through line (18) to a storage tank and/or through line (12) for recirculation through the spray bar (26).

Figure 2:
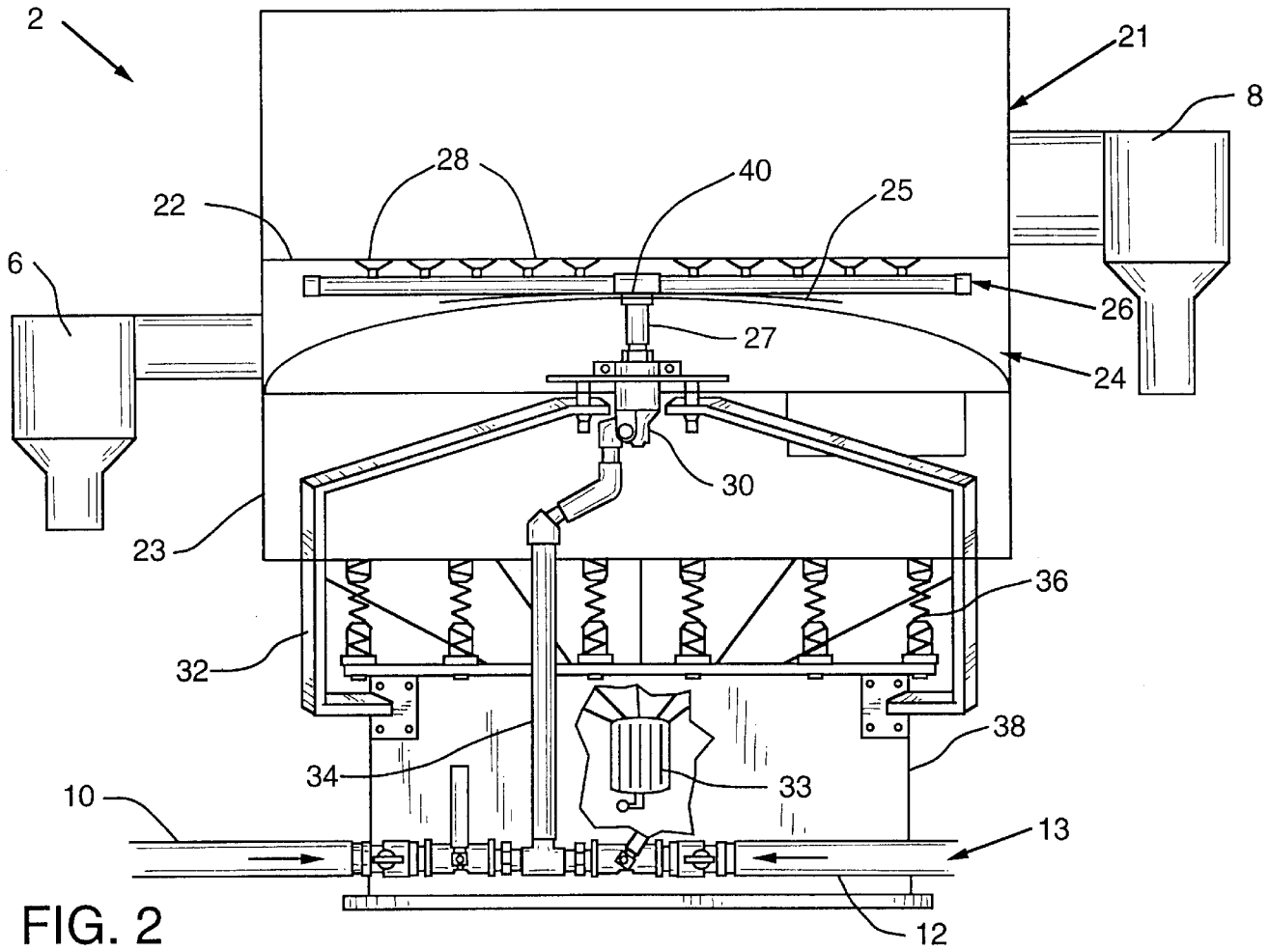
FIG. 2 is a detailed cross-sectional drawing illustrating a self-propelled recirculative spray bar fitted to a circular vibratory separator.
Figure 2A:
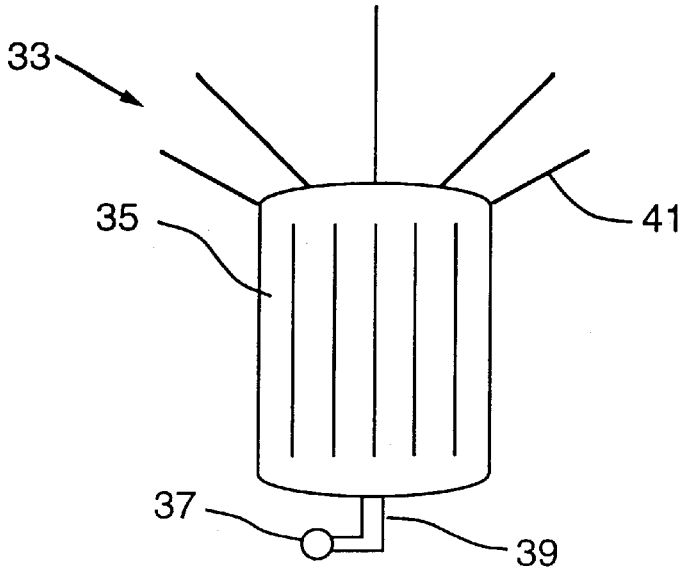
FIG. 2A is a cutaway view showing the vibrating means for the separator of FIG. 2.
Figure 3:
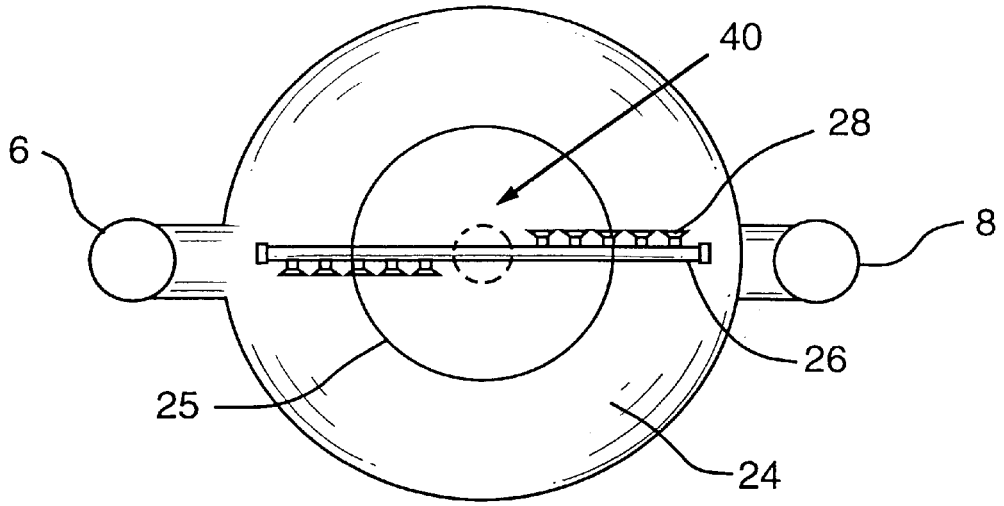
FIG. 3 is a top view of the assembly of FIG. 2.

As seen in detail in FIGS. 2 and 3 the spray bar (26) is emplaced so that recirculated product and/or water is sprayed through nozzles (28) to impinge upon the lower surface of the screen and prevent blinding as described elsewhere. The spray bar and hollow shaft (27) are supported by support frame (32) and rotating union (30). The product tub (24) is an enclosed round dome structure with cover and a shield (25). Shield (25) directs the screened product away from the center of the apparatus and into product tub (24). The upper portion of the structure is reject tub (21), and the lower portion is spacer tub (23). The working fluid (13) which is product or screened slip from the product tank is channeled to the spray bar via line (12) and direct line (34). The separator is supported by springs (36) and vibrated by vibrating means (33) which are shown schematically. Any suitable vibrating means (33) can be used, such as, e.g. the motor (35) with counterweight (37) attached to shaft (39), which motor is attached to plates (41) and thus causes the attached tubs and screen springs (36) to vibrate. These features are shown in cutaway FIG. 2A. The spray bar shaft (27) passes through hole (40) in the product tub's dome and shield (25). Preferably, the nozzles are offset slightly from the vertical so as to provide a combined lateral force to rotate the spray bar through jet effect as shown for nozzles (28) in FIG. 3 and described above. For example, the nozzles can be adjusted to an angle from the vertical ranging from 15 to 75 degrees, preferably ranging from 30 to 60 degrees.

Figure 6:
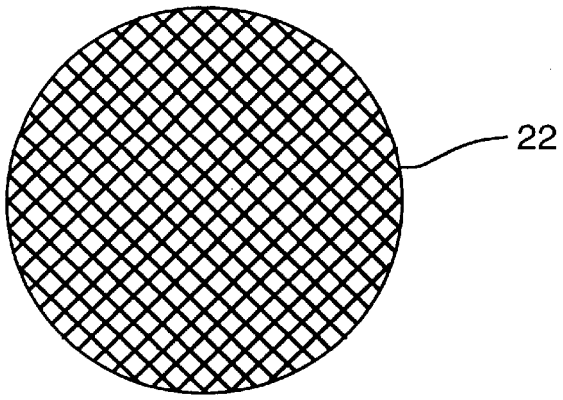
FIG. 6 is a top view of the screen panel typically employed in the vibratory separators.

A typical mesh screen in enlarged scale is shown in FIG. 6. Such screens when used for screening powdered kaolin typically range from 80 to about 625 mesh, but can be any suitable mesh for screening a slurry of a given particulate material.

Figure 4:
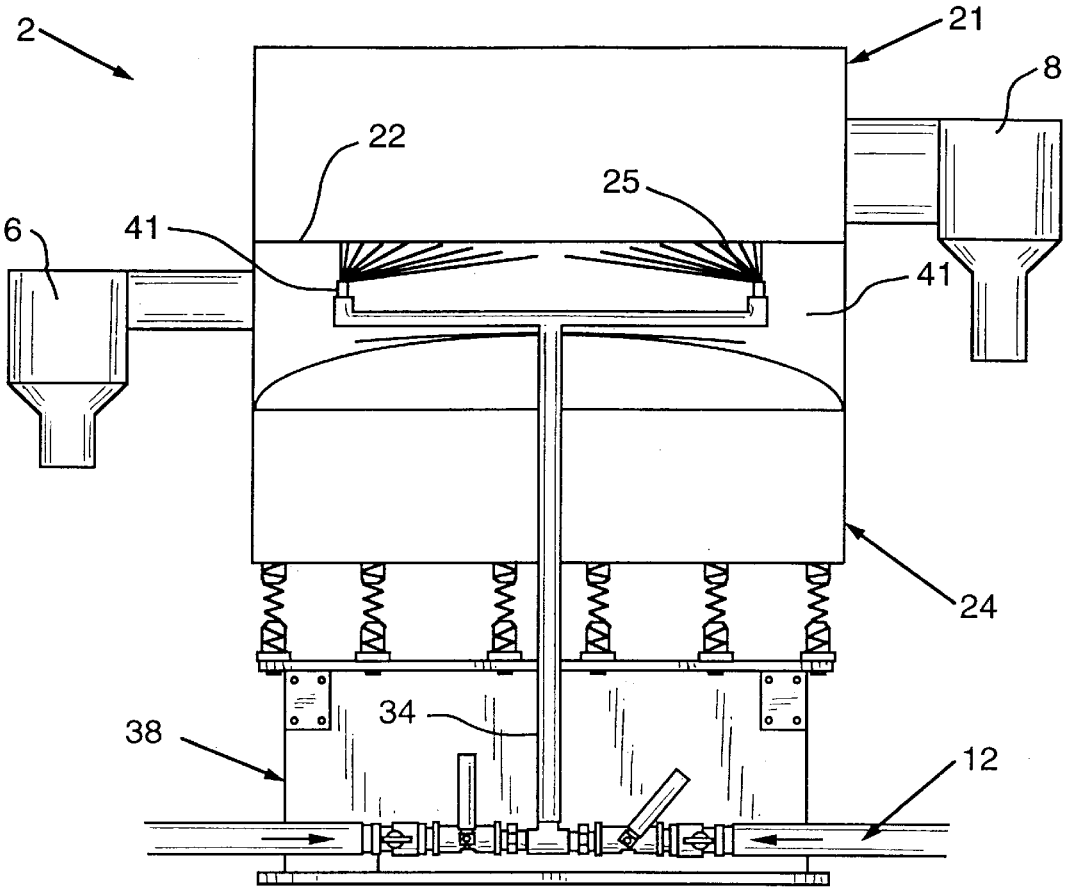
FIG. 4 is a cross-sectional view of a circular vibratory separator incorporating stationary nozzles for spraying the underside of the screen.

FIG. 4 illustrates in cross-section a circular vibratory separator similar to that of FIGS. 2 and 3, but including stationary nozzles (41) which are installed in stationary positions around periphery of the separator in place of the spray bar so as to spray the bottom of the screen uniformly when activated intermittently. These nozzles branch out from line (34) which penetrates the product dome and is attached to the shield (25) at the center to minimize adverse effects of vibration. The shield (25) and line (34) are preferably mounted rigidly outside the machine, i.e. to base (38).

Figure 5:
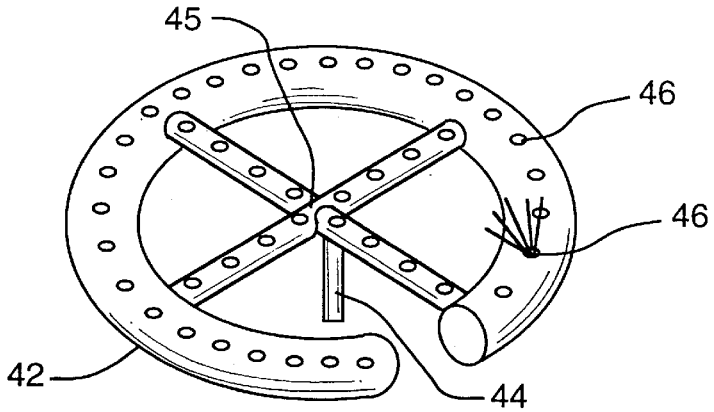
FIG. 5 is a perspective view of a toroidal manifold incorporating nozzles which may be installed inside a circular vibratory separator to wash the underside of the screen.

FIG. 5 illustrates an alternative nozzle installation based upon a toroidal manifold (42) connected by line (44) and cross-line(s) (45) to the recirculated product line (34) of FIG. 2 and having nozzles (46) around its periphery which are aimed so as to uniformly wash the underside of the screen when activated. Such a nozzle manifold can be installed inside the periphery of the reject tub (21) in place of the spray bar or the individual stationary nozzles. The spray should be intermittent, with a spray rate effective to keep the screen free of blinding.

The spray bar works by preventing the two primary causes of screen blinding. These two types of blinding are plastic blinding, caused by fine moist clay and reject particles clinging to or being trapped by the wires of the screen and eventually plastering over areas of the screen, and blanketing, caused by particles sticking together by either cementing or surface tension effects. In actuality, both of these phenomena are occurring at the same time. In the current screening process, as the slip encounters the screen, the majority of the clay passes through the screen near the center, but some of the slip splashes out of this central zone to other areas of the screen. Since these areas are not wet continuously they have time to accumulate rejects that dry on the surface or in the apertures of the screen. As these areas of rejects remain stationary and begin to dry, plastic blinding and blanketing occur. With time, the accumulation of these blinded areas reduces the effective screening area to a point at which the screen floods and feed is lost through the reject spout. When one screen floods, the level in the product tank begins to decrease and the feed rate on the bank of screens begins to increase because the level control in the product tank activates an automatic valve and attempts to compensate for the reduced tank level. At this point the other screens are delivered more and more feed to compensate for this loss of product. These screens begin to blind at an accelerated rate and the situation approaches a "domino-effect" resulting in more and more screens flooding. This process disturbance can be readily seen with the more coarse and residuous (residue laden) grades of clay.

On the other hand, the spray bar is continuously wetting and washing the entire screen surface, except for an approximately six inch wide ring around the outermost edge. This six inch no-spray-zone was designed to provide a reject route and to prevent dilution of the rejects. The result is a consistent effective screening area and reject band that does not provide an opportunity for reject materials to accumulate, dry, and eventually blind and flood the screen. In fact, it was observed that the spray actually causes the feed to be transported and flow across the effective screening area on a sort of fluid cushion.

As the feed contacts the screen it apparently encounters a thin layer of the recirculated slip from the spray bar that has penetrated the screen. This thin layer of slip minimizes the frictional forces by providing a medium for the feed to flow across. This effect may greatly enhance the screening process because as the feed flows towards the outer regions of the screen, the product passes through the screen and the rejects remain on top of the screen with sufficient momentum to help carry them to the reject band. There also appears to be another mechanism present which is the downward force provided by gravity, capillary forces, and surface tension. As the screened slip is sprayed on the bottom of the screen it penetrates momentarily and then forms droplets on the under side of the screen. As these droplets, which are under the influence of gravity, combine with the feed passing through the screen, they help to pull the feed through the screen apertures in a capillary fashion. This phenomenon can be observed when the wand is turned off and the screen begins to pool and flood. (The screen has not yet had time for plastic blinding and blanketing to occur but pooling and subsequent flooding occur because the mechanisms that aid the screening when the spray bar is running are no longer present.) When the spray bar is turned back on the pool begins to disappear. The combination of the mechanisms discussed above maintains a consistent screening environment helping to eliminate the process disturbance of blinding, while at the same time significantly enhancing production rates and product residues.

The spray bar can be operated intermittently, but is preferably operated continuously during the screening process. The spray rate is adjusted to prevent screen blinding, and will vary according to the process and apparatus. For example, in a system using 48 inch vibratory screens and having a production rate ranging from 1 to 150 gpm, the spray rate may range from 0.1 to 20 gpm.

EXAMPLES

The invention is demonstrated in the following Examples which are intended to be illustrative but non-limiting.

Example 1

Currently, products are screened to remove residue up to a mesh size of 325. These products if screened through a finer mesh screen, like a 400 mesh, would contain much less residue and be potentially more saleable and/or valuable. However, current state-of-the-art vibratory screening does not provide a uniform screening area and blinding occurs often. To use a 400 mesh screen instead of the currently used 325 mesh screen would worsen blinding, production rates and process difficulties to a point at which such change would not be feasible. On the other hand, with the use of the spray bar as shown in FIGS. 1–3, it has been found that screening at a finer mesh is easily accomplished with either current or increased production rates and with substantially reduced screen residues. This process improvement works well with all grades except for those with relatively large percentages of undesirable oversize material.

The tests compared a current production unit with a 325 mesh screen as control to the experimental unit with a 400 mesh screen. Production rates, product residues, reject rates, and reject solids measurements were made to evaluate the performance of the screens. Five commercial grades of clay were evaluated for the preliminary tests that represent the range of particle sizes the screens will encounter: clays denominated as Clays I, II, III, IV and V. The tabulated results are set forth in Tables I through V. The average percentages of improvement were calculated by dividing the differences in the measured quantities by the original quantities. That is, e.g., the increasing production rate or reject rate would be divided by the original rate, and the decreases in product residue would be divided by the original values.

TABLE 1

CLAY I
(A Fine #1 Coating Pigment of Regular Brightness)

| | PRODUCTION SCREEN 325 MESH | | TEST SCREEN SPRAY BAR ON 400 MESH | | AVERAGE IMPROVEMENT | |
|---|---|---|---|---|---|---|
| Production Rate (gpm) | 29.89 | | 114.34 | | | |
| | 23.45 | | 76.97 | | | |
| | 38.65 | | 78.76 | | | |
| | 37.64 | | 67.04 | | | |
| | 37.08 | | 72.16 | | | |
| AVERAGE | 33.34 | | 81.85 | | 145.5% | |
| SCREEN PRODUCT | % RETAINED ON | | % RETAINED ON | | % RETAINED ON | |
| Lab Sieve | 325 Mesh | 400 Mesh | 325 Mesh | 400 Mesh | 325 Mesh | 400 Mesh |
| Product Residue (%) | 0.00014 | 0.00050 | 0.00008 | 0.00016 | (C < A) | (D < B) |
| | 0.00004 | 0.00022 | 0.00000 | 0.00006 | | |
| | 0.00020 | 0.00032 | 0.00006 | 0.00016 | | |
| | 0.00002 | 0.00020 | 0.00000 | 0.00004 | | |
| | 0.00030 | 0.00036 | 0.00018 | 0.00044 | | |
| AVERAGE | 0.00014 | 0.00032 | 0.00006 | 0.00017 | 57.14% | 46.88% |
| | (A) | (B) | (C) | (D) | | |
| REJECT RATE (GM/SEC) | 0.18 | | 0.43 | | | |
| | 0.10 | | 0.14 | | | |
| | 0.09 | | 0.18 | | | |
| | 0.11 | | 0.18 | | | |
| | 0.12 | | 0.33 | | | |
| AVERAGE | 0.12 | | 0.25 | | 108.3% | |
| Reject Solids (%) | 31.63 | | 31.08 | | | |
| | 32.63 | | 31.02 | | | |
| | 31.41 | | 29.91 | | | |
| | 28.92 | | 30.16 | | | |
| | 28.84 | | 31.33 | | | |
| AVERAGE | 30.69 | | 30.70 | | 0.03% | |

TABLE 2

CLAY II
(A #1 Coating Pigment of Regular Brightness)

(A Fine #1 Coating Pigment of Regular Brightness)

| | PRODUCTION SCREEN 325 MESH | | TEST SCREEN SPRAY BAR ON 400 MESH | | AVERAGE IMPROVEMENT | |
|---|---|---|---|---|---|---|
| Production Rate (gpm) | 39.10 | | 68.22 | | | |
| | 37.01 | | 67.00 | | | |
| | 36.09 | | 57.05 | | | |
| | 35.57 | | 56.71 | | | |
| | 34.69 | | 57.97 | | | |
| AVERAGE | 36.49 | | 61.39 | | 68.24% | |
| SCREEN PRODUCT | % RETAINED ON | | % RETAINED ON | | % RETAINED ON | |
| Lab Sieve | 325 Mesh | 400 Mesh | 325 Mesh | 400 Mesh | 325 Mesh | 400 Mesh |
| Product Residue (%) | 0.00060 | 0.00172 | 0.00022 | 0.00028 | | |
| | 0.00120 | 0.00556 | 0.00008 | 0.00218 | | |
| | 0.00154 | 0.00470 | 0.00044 | 0.00142 | | |
| | 0.00150 | 0.00544 | 0.00034 | 0.00112 | | |
| | 0.00114 | 0.00560 | 0.00022 | 0.00156 | | |

TABLE 2-continued

CLAY II
(A #1 Coating Pigment of Regular Brightness)

(A Fine #1 Coating Pigment of Regular Brightness)

| | PRODUCTION SCREEN 325 MESH | | TEST SCREEN SPRAY BAR ON 400 MESH | | AVERAGE IMPROVEMENT | |
|---|---|---|---|---|---|---|
| AVERAGE | 0.00120 | 0.00460 | 0.00026 | 0.00131 | 78.33% | 71.52% |
| | (A) | (B) | (C) | (D) | | |
| REJECT RATE (GM/SEC) | 0.23 | | 0.35 | | | |
| | 0.29 | | 0.26 | | | |
| | 0.38 | | 0.54 | | | |
| | 0.33 | | 0.39 | | | |
| | 0.22 | | 0.30 | | | |
| AVERAGE | 0.29 | | 0.37 | | 27.59% | |
| Reject Solids (%) | 31.20 | | 30.22 | | | |
| | 29.05 | | 31.26 | | | |
| | 31.00 | | 30.59 | | | |
| | 32.22 | | 30.59 | | | |
| | 31.82 | | 30.35 | | | |
| AVERAGE | 31.06 | | 30.60 | | −1.5% | |

TABLE 3

CLAY III
(A Delaminated Filling Pigment of High Brightness)

| | PRODUCTION SCREEN 325 MESH | | TEST SCREEN SPRAY BAR ON 400 MESH | | AVERAGE IMPROVEMENT | |
|---|---|---|---|---|---|---|
| Production Rate (gpm) | 24.53 | | 64.37 | | | |
| | 30.53 | | 69.67 | | | |
| | 31.08 | | 63.17 | | | |
| AVERAGE | 28.71 | | 65.74 | | 128.9% | |
| SCREEN PRODUCT | % RETAINED ON | | % RETAINED ON | | % RETAINED ON | |
| Lab Sieve | 325 Mesh | 400 Mesh | 325 Mesh | 400 Mesh | 325 Mesh | 400 Mesh |
| Product Residue (%) | 0.00016 | 0.00078 | 0.00020 | 0.00042 | | |
| | 0.00018 | 0.00084 | 0.00008 | 0.00032 | | |
| | 0.00014 | 0.00072 | 0.00012 | 0.00024 | | |
| AVERAGE | 0.00016 | 0.00078 | 0.00013 | 0.00033 | 18.75% | 57.69% |
| | (A) | (B) | (C) | (D) | | |
| REJECT RATE (GM/SEC) | 0.22 | | 0.26 | | | |
| | 0.12 | | 0.24 | | | |
| | 0.25 | | 0.48 | | | |
| AVERAGE | 0.20 | | 0.33 | | 65.0% | |
| Reject Solids (%) | 26.74 | | 28.85 | | | |
| | 26.84 | | 28.94 | | | |
| | 28.87 | | 28.76 | | | |
| AVERAGE | 27.48 | | 28.85 | | 4.99% | |

TABLE 4

CLAY IV
(A #2 Coating Pigment of Regular Brightness)

| | PRODUCTION SCREEN 325 MESH | | TEST SCREEN SPRAY BAR ON 400 MESH | | AVERAGE IMPROVEMENT | |
|---|---|---|---|---|---|---|
| Production Rate (gpm) | 27.89 | | 26.50 | | | |
| | 26.10 | | 28.24 | | | |
| | 27.25 | | 28.62 | | | |
| | 27.69 | | 28.73 | | | |
| AVERAGE | 27.23 | | 28.02 | | 2.90% | |
| SCREEN PRODUCT | % RETAINED ON | | % RETAINED ON | | % RETAINED ON | |
| Lab Sieve | 325 Mesh | 400 Mesh | 325 Mesh | 400 Mesh | 325 Mesh | 400 Mesh |

TABLE 4-continued

CLAY IV
(A #2 Coating Pigment of Regular Brightness)

| | PRODUCTION SCREEN 325 MESH | | TEST SCREEN SPRAY BAR ON 400 MESH | | AVERAGE IMPROVEMENT | |
|---|---|---|---|---|---|---|
| Product Residue (%) | 0.00070 | 0.01090 | 0.00045 | 0.00125 | | |
| | 0.00050 | 0.01305 | 0.00050 | 0.00275 | | |
| | 0.00040 | 0.01485 | 0.00025 | 0.00090 | | |
| | 0.00020 | 0.01430 | 0.00010 | 0.00140 | | |
| AVERAGE | 0.00045 | 0.01328 | 0.00033 | 0.00158 | 26.67% | 88.10% |
| | (A) | (B) | (C) | (D) | | |
| REJECT RATE (GM/SEC) | 1.19 | | 2.85 | | | |
| | 2.43 | | 4.03 | | | |
| | 1.34 | | 2.07 | | | |
| | 1.47 | | 4.59 | | | |
| AVERAGE | 1.61 | | 3.39 | | 110.6% | |
| Reject Solids (%) | 33.83 | | 34.02 | | | |
| | 35.19 | | 34.00 | | | |
| | 33.53 | | 33.44 | | | |
| | 34.72 | | 34.98 | | | |
| AVERAGE | 34.32 | | 34.11 | | −0.61% | |

TABLE 5

CLAY V
(A Synthetic Water-Washed Filling Pigment of Low Brightness)

| | PRODUCTION SCREEN 325 MESH | | TEST SCREEN SPRAY BAR ON 400 MESH | | AVERAGE IMPROVEMENT | |
|---|---|---|---|---|---|---|
| Production Rate (gpm) | 18.15 | | 17.10 | | | |
| | 15.93 | | 17.48 | | | |
| | 16.00 | | 18.98 | | | |
| | 14.85 | | 15.75 | | | |
| | 14.75 | | 16.35 | | | |
| AVERAGE | 15.94 | | 17.13 | | 7.47% | |
| SCREEN PRODUCT Lab Sieve | % RETAINED ON 325 Mesh | 400 Mesh | % RETAINED ON 325 Mesh | 400 Mesh | % RETAINED ON 325 Mesh | 400 Mesh |
| Product Residue (%) | 0.17800 | | 0.03550 | | | |
| | 0.32500 | | 0.03980 | | | |
| | 0.19430 | | 0.03350 | | | |
| | 0.00795 | 0.24205 | 0.00010 | 0.03290 | | |
| | 0.00590 | 0.18760 | 0.00040 | 0.03170 | | |
| AVERAGE | 0.00693 | 0.22539 | 0.00025 | 0.03468 | 96.39% | 84.61% |
| | (A) | (B) | (C) | (D) | | |
| REJECT RATE (GM/SEC) | 8.41 | | 7.12 | | | |
| | 6.48 | | 9.08 | | | |
| | 13.30 | | 11.26 | | | |
| | 14.51 | | 16.38 | | | |
| | 10.57 | | 9.63 | | | |
| AVERAGE | 10.65 | | 10.69 | | 0.38% | |
| Reject Solids (%) | 35.04 | | 41.26 | | | |
| | 35.10 | | 38.70 | | | |
| | 24.97 | | 37.74 | | | |
| | 26.89 | | 36.57 | | | |
| | 24.80 | | 32.92 | | | |
| AVERAGE | 29.36 | | 37.44 | | 27.52% | |

TABLE 6

CLAY VI
(A Natural Water-Washed Filler Clay-Like Clay V)

| | PRODUCTION SCREEN 325 MESH | TEST SCREEN SPRAY BAR ON 325 MESH | AVERAGE IMPROVEMENT |
|---|---|---|---|
| Production Rate (gpm) | 21.98 | 41.63 | |
| | 21.07 | 38.38 | |
| | 18.78 | 37.48 | |

TABLE 6-continued

CLAY VI
(A Natural Water-Washed Filler Clay-Like Clay V)

| | PRODUCTION SCREEN 325 MESH | TEST SCREEN SPRAY BAR ON 325 MESH | AVERAGE IMPROVEMENT |
|---|---|---|---|
| AVERAGE | 20.60 | 39.16 | 90.10% |
| SCREEN PRODUCT Lab Sieve | % RETAINED ON 325 Mesh | % RETAINED ON 325 Mesh | % RETAINED ON 325 Mesh |
| Product Residue (%) | 0.00075 | 0.00085 | |
| | 0.00075 | 0.00025 | |
| | 0.00070 | 0.00095 | |
| AVERAGE | 0.00073 | 0.00068 | 7.35 |
| | (A) | (B) | |
| REJECT RATE (GM/SEC) | 4.53 | 4.02 | |
| | 3.51 | 7.82 | |
| | 12.77* | 4.85 | |
| AVERAGE | 4.02 | 5.56 | 38.3% |
| Reject Solids (%) | 34.51 | 34.30 | |
| | 30.88 | 38.85 | |
| | 26.71 | 35.89 | |
| AVERAGE | 30.70 | 35.55 | 15.8% |

*Partially Flooded For This Sample.

Current production rates were met or exceeded with a 400 mesh screen on all grades evaluated except for one, a more residuous coarse grade (Clay VI). An effective method of processing this material might be to utilize a combination of screens with spray bars and 325 mesh screens as well as with spray bars and 400 mesh screens in order to handle any excess demand.

The product residues were greatly improved by the use of a 400 mesh screen on all the grades tested, except for Clay VI. The residues were checked on both 325 and 400 mesh sieves in the lab. The 325 mesh residues from the test unit contained from about 7 to about 96 percent less residue, while the 400 mesh residues contained from about 45 to about 88 percent less residue. The overall product residues would have been even less if more of the screens feeding the product tank had had 400 mesh screens and spray bars installed. In this experiment, the recirculated slip consisted, by a large percentage, of product produced by current production units with 325 mesh screens without spray bars. As product samples were obtained from the test unit with the spray bar on, residue in the products from the other production units was present in the samples. Consequently, the test unit's production residues reported herein could be further improved by 4 percent to 20 percent. This means that if the other screening machines that were being operated and that were discharging their product into the large product tank had spray bars, then the residue in the tank would be less as would be the slip being sprayed on the underside of the screens, especially if 400 mesh screens were used on all units as well. In this study, only one out of ten units had the spray bar installed.

The reject rates were typically higher on the test unit, with improvements of 0.4 percent to 108 percent. This is to be expected because the 400 mesh screen is removing an increased amount of the undesirable components in the slip. This is of course the primary reason for the greatly improved product residues when operating with a 400 mesh screen. The spray bar also helps to route the rejects to a reject zone around the outer region of the screen resulting in a more efficient rejection mechanism. Residue is promptly ejected and does not remain on the screen surface.

Some of the residue that remains on screens without spray bars will work its way through and into the product.

The reject solids of the clay grades tested were relatively consistent from the current unit to the experimental unit.

This is not surprising because the 400 mesh screen is primarily removing more rejects at the same solids content. However, the reject solids from Clay V on the test screen were substantially higher than on the control screen. This is probably due to the abundance of reject materials present in this clay, and because the larger ring or bed of rejects that forms has a greater chance to shed liquid.

Example 2

The grades of clay that contain large percentages of oversize material are difficult to screen due to frequent blinding and insufficient reject removal. In fact, current screening production rates of these grades using 325 mesh screens are not sufficient and typically cause processing problems. While these grades cannot be screened at current production rates utilizing the spray bar and a 400 mesh screen, they can be screened utilizing the spray bar and the currently used 325 mesh screen with excellent results. The most common grade of clay with elevated levels of oversized material has typical screening production rates of 20 gpm. With the use of the spray bar, these production rates can be nearly doubled with no potential for blinding.

In fact, current Clay V and VI screening production rates are inadequate at 15–22 gpm, because these rates cause processing problems. The leach process is set up ideally for production rates of about 350 gpm or higher, for a bank of 10 48 inch screens. The low production rates of Clays V and VI cause process problems which result in leach chemical waste and unsuitable leaching due to fluctuating feed rates, and the fact that the feed can not keep up with the production pumps. This causes surging in the system. The main cause is that since this clay contains a relatively large percentage of reject material it is difficult to screen because of its tendency to build up and blind the screens. As this happens, the feed rate is continuously being adjusted to maintain a constant level in the product tank. When the feed rate automatically increases due to a blinded screen, the leach dosage, after some delay, also increases. Once the first screen blinds the other screens begin to blind and flood at an accelerated rate because of the increased feed. Periodically, the operators wash the blinded screens and the feed rates return to normal. What happens as a result of the increased frequency of blinded screens and fluctuations in the feed rates and leach dosages is that underdosing and overdosing of the leach chemicals occur continually. Because of the delay, the leach dosage adjustment is always trying to catch up to the feed rate. This in turn leads to difficulty in controlling the pH of the leached product.

Consequently, testing was performed with Clay VI, which compared the current unit to the experimental unit, both with 325 mesh screens installed, to see how production rates and blinding would be influenced by the use of the spray bar. Tabulated results can be seen in Table VI. Production rates were improved by an average of 90 percent using a 325 mesh screen.

The feed rate of the control unit was set by the operator and represents an ordinary production setting. The feed rate of the test screen was set to a point at which it could operate ideally for an extended period of time. The corresponding production rate of the control screen averaged 20.6 gpm and showed progressive degrees of blinding. Any increase in this rate would result in an increased frequency of blinding, flooding, and leach inconsistency. The production rate of the test screen averaged 39.2 gpm with no signs of buildup or blinding. This is nearly double the current production rate and a 90.1 percent improvement. The use of the spray bar substantially increased the screening performance and eliminated the tendency of blinding on the 325 mesh screen. The reasons for these improvements lie in the washing and wetting effects of the spray bar as well as other mechanisms which were reported in detail previously.

The product residues were for the most part unchanged, with both control and test screen products having 325 mesh residues of 0.0006–0.0007 percent. Significant improvement of product residues was not expected because both the control and test units were equipped with 325 mesh screens. However, improvement was observed.

Figure 7:
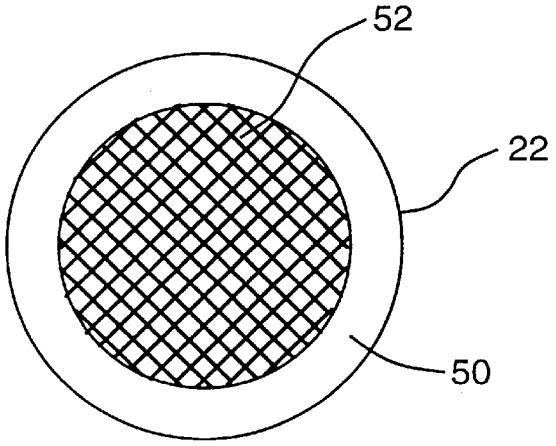
FIG. 7 is a schematic top view of the screen panel of FIG. 6 illustrating separator operation with the spray bar of the invention. The white band represents the band of rejects located in the no spray zone.
Figure 8:
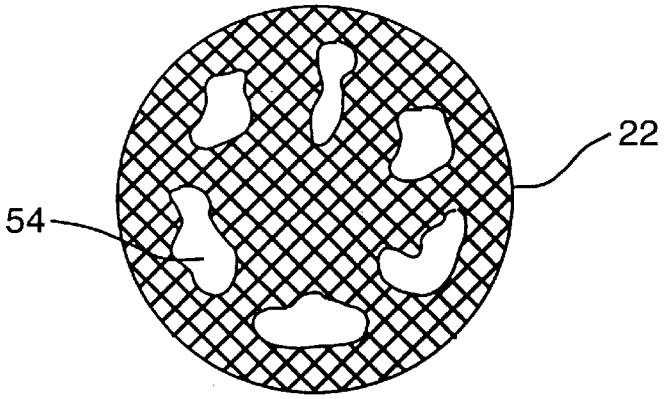
FIG. 8 represents the operation without the spray bar with the random white patches showing the accumulation of residue that leads to blinding.

Improvement of the reject rate was evident on the test screen, as illustrated in FIGS. 7 and 8. The reject rates were about 38 percent higher on the test unit than on the control unit. This, as reported earlier, is because the rejects on the test unit are isolated in a band around the outer edge of the screen (22). This consistent band of rejects promotes their ejection from the screen, primarily because the action of the spray bar prevents the rejects from reentering the effective screening area once they have passed over it. During operation, the entire effective screening area is wet. This is unlike the control screen, (22) in FIG. 8, which under typical screening circumstances does not have a uniform effective screening area and ejects some of the rejects, while other rejects remain at various and random areas (54) on the screen to dry, causing blinding. The remainder of the screening area is wet, but is less effective due to the blinded areas. Once blinding occurs, feed is lost down the reject funnel or spout. Evidence of this can be seen from the tabulated data in Table VI in which a reject rate of 12.77 gm/sec was recorded from the control screen. This data point was not used in averaging the control screen's reject rate because most of the material being ejected is feed. The control screen was running somewhat full due to blinding, a familiar condition with the more residuary grades, and approximately 8 gm/sec of feed was being lost. As blinding intensifies more feed will be lost, until finally the screen floods and a crucial proportion of the feed is wasted.

Similarly, the reject solids were consistently higher on the test screen than on the control screen. This follows, because as the feed is being ejected with the rejects the solids content will naturally decrease.

The results of this test again show that substantial improvements in the current process can be achieved by augmenting the screening process with the spray bar technology. As a result, blinding and flooding have been eliminated and significant gains in screening production rates of a high residue grade such as Clay VI have been observed.

Figure 9:
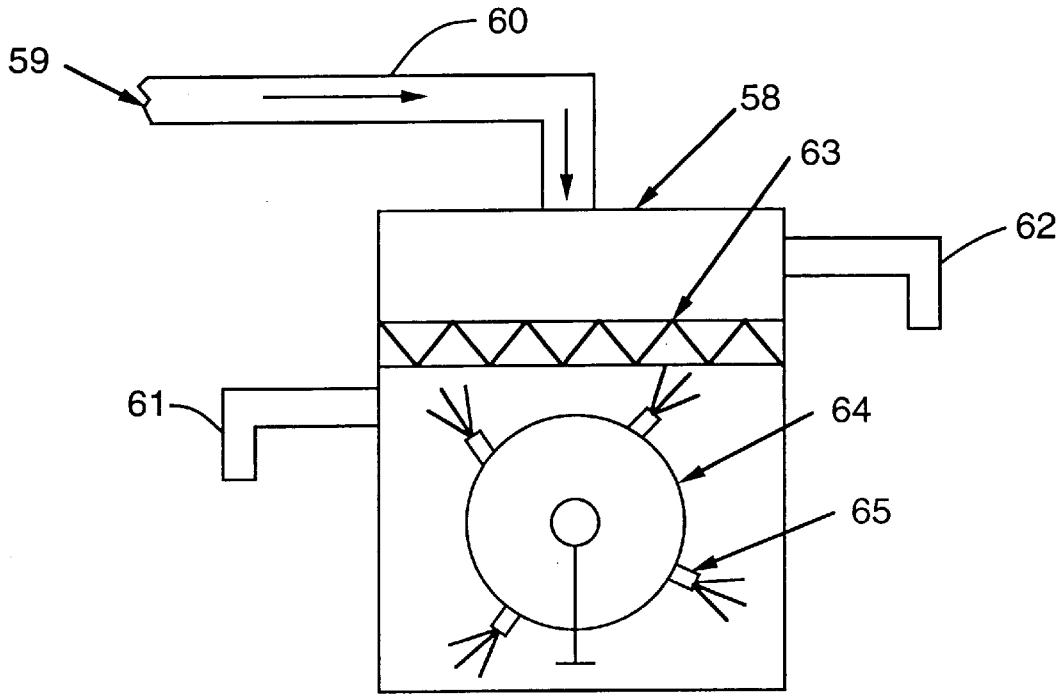
FIG. 9 is a schematic side view illustrating separator operation with a rotatable drum of the invention.
Figure 10:
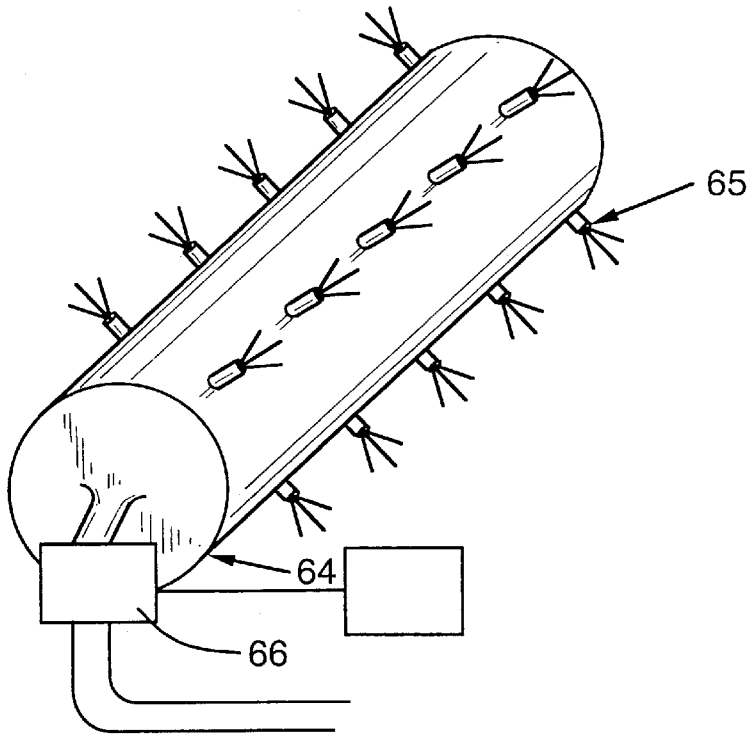
FIG. 10 is a schematic perspective view of the rotatable drum of FIG. 9.

FIGS. 9 and 10 illustrate a further embodiment of the present invention. A vibratory separator 58 receives feed 59 for the screen 63 from feed line 60. Reject material is discharged through channel 62 and the filtrate product is discharged through line 61. Additional features and operation of separator 58 are essentially similar to those for separator 2 except that drum 64 replaces spray bar 26. Drum 64 is mounted for rotation about a horizontal axis and has a plurality of spray nozzles 65 which are arranged around the circumference of the drum 64 and are directed at an acute angle from the radii of drum 64. A feed line 66 feeds either filtrate or water, as discussed hereinabove, to drum 64, and this fluid is delivered to spray nozzles 65. Pumping of this fluid or liquid into drum 64 and through nozzles 65 tend to provide an impulse action causing the rotation of the drum 64 whereby the sprays from nozzles 65 impinge against the underside of screen 63 to dislodge the residue from the top of screen 63 in accordance with the teachings of the invention.

While the present invention has been particularly set forth in terms of specific embodiments thereof, it will be understood in view of the present disclosure, that numerous variations upon the invention are now enabled to those skilled in the art, which variations yet reside within the scope of the instant teachings. Accordingly, the invention is to be broadly construed, and limited only by the scope and spirit of the claims now appended hereto.

What is claimed is:

1. A method for screening a liquid slurry of particulate matter comprising the steps of:

directing said slurry into screening means which pass a filtrate to a vessel and retain a residue;

directing a plurality of streams of a fluid against the underside of said screening means to dislodge said residue from said screening means; and selectively using said filtrate or water as said fluid being directed against the underside of said screening means.

2. The method of claim 1 further comprising providing a plurality of stationary nozzle means for said directing of a plurality of streams of fluid against said underside of said screening means.

3. The method of claim 2 further comprising depositing said filtrate into a cylindrical vessel prior to said recirculating of said filtrate and, providing said nozzles in a toroidal manifold concentric with said cylindrical vessel.

4. The method of claim 1 further comprising providing rotatable spray means below said screening means for said directing of a plurality of streams of fluid against said screening means.

5. The method of claim 4 further comprising providing said spray means with at least one spray bar means rotatable in a horizontal plane.

6. The method of claim 5 further comprising providing said spray bar with spray nozzles directed at an acute angle from the vertical to provide an horizontal impulse to rotate said spray bar means and to provide a vertical spray component impinging the underside of said screening means.

7. The method of claim 5 further comprising providing said spray bar means with means for rotating said spray bar means about the center of said vessel.

8. The method of claim 4 further comprising providing said rotatable spray means with at least one drum rotatable about a horizontal axis and having a plurality of spray nozzles arranged on the circumference thereof and directed at an acute angle from the radii of the drum to provide impulse for the rotation of the drum and for the spraying of the underside of said screening means.

9. The method of claim 4 further comprising providing pumping means for pumping said fluid to said spray means for rotating said spray means for said directing of said fluid against the underside of said screening means.

10. The method of claim 5 further comprising directing the nozzles of said spray bar means as to provide sufficient impulse when said fluid is pumped through said nozzles of said spray bar means as to rotate said spray bar means while directing said streams of fluid against the underside of said screening means.

11. The method of claim 10 wherein said particulate mineral matter is selected from the group consisting of clays, calcium carbonate and calcium sulfate.

12. The method of claim 10 wherein said particulate mineral matter comprises at least one ground ore.

13. The method of claim 1 further comprising using said filtrate as said fluid.

14. The method of claim 1 further comprising using said water as said fluid.

15. The method of claim 1 wherein said slurry is an aqueous slurry.

16. The method of claim 1 wherein said slurry comprises particulate mineral matter.

17. The method of claim 1 wherein said particulate matter comprises a pigment.

18. The method of claim 1 wherein said particulate matter comprises a ceramic material.

19. The method of claim 1 wherein said particulate matter comprises a foodstuff or industrial starch.

20. The method of claim 1 wherein said particulate matter comprises at least one polymeric material.

21. The method of claim 1 wherein said screening means include vibratory means.

22. Apparatus for screening a liquid slurry of particulate matter, comprising:

means for directing said slurry into screening means;

said screening means comprising a reservoir for said slurry and at least one screen which passes a filtrate of said slurry and retains a residue;

spray means for directing a plurality of streams of a fluid against the underside of said at least one screen to dislodge residue from said screen and improve the screening process;

vessel means for accumulating and recovering said filtrate of said slurry; and fluid selective means for selectively using said filtrate or water as said fluid being directed against said underside of said screen.

23. The apparatus of claim 22 wherein said spray means comprises a plurality of stationary nozzle means.

24. The apparatus of claim 22 wherein said vessel means comprises a cylindrical vessel and wherein said spray means are contained in a toroidal manifold concentric within said vessel.

25. The apparatus of claim 22 wherein said spray means comprises rotatable nozzle means mounted below said screening means.

26. The apparatus of claim 22 wherein said spray means comprise at least one spray bar adapted to rotate in a horizontal plane.

27. The apparatus of claim 26 wherein said spray bar comprises spray nozzles directed at an acute angle from the vertical to provide horizontal impulse to rotate said spray bar and to provide a vertical spray component impinging the underside of said screening means.

28. The apparatus of claim 26 wherein said spray bar is rotatably mounted about the center of said vessel means.

29. The apparatus of claim 26 further comprising means for pumping said fluid through said spray bar and rotating said spray bar.

30. The apparatus of claim 26 wherein said nozzle means in said spray bar are so directed as to provide sufficient impulse when said fluid is pumped through said spray bar as to rotate said spray bar while directing said streams of fluid against the underside of said screening means.

31. The apparatus of claim 26 wherein said spray means comprise at least one drum rotatable about a horizontal axis and having a plurality of spray nozzles arranged on the circumference thereof and directed at an acute angle from the radii of said drum to provide impulse for the rotation of said drum and to spray the underside of said screening means.

32. The apparatus of claim 22 wherein said fluid selective means comprises pumping means for pumping said filtrate through said nozzle means.

33. The apparatus of claim 22 wherein said fluid selective means comprises pumping means for pumping said water through said nozzle means.

34. The apparatus of claim 22 which is adapted to screen aqueous slurries.

35. The apparatus of claim 22 wherein said screening means include vibratory means.

36. A method for screening a liquid slurry of particulate matter comprising the steps of:

directing said slurry into screening means which pass a filtrate to a vessel and retain a residue;

directing a plurality of streams of a fluid against the underside of said screening means to dislodge said residue from said screening means; and using said filtrate as said fluid.

37. Apparatus for screening a liquid slurry of particulate matter, comprising:

screening means;

means for directing said slurry into said screening means;

said screening means comprising a reservoir for said slurry and screen means which passes a filtrate of said slurry and retains a residue;

spray means for directing a plurality of streams of fluid against the underside of said screen means to dislodge residue from said screen means thereby improving the screening process;

vessel means for accumulating and recovering said filtrate of said slurry; and said spray means comprising drum means rotatable about a horizontal axis and having a plurality of spray nozzles arranged on the circumference thereof and directed at an acute angle from the radii of said drum means to provide an impulse for rotation of said drum means and for spraying said underside of said screening means.

38. A method for screening a liquid slurry of particulate matter comprising the steps of:

directing said slurry into screening means which pass a filtrate into a vessel and retain a residue;

directing a plurality of streams of a fluid against the underside of said screening means to dislodge said residue from said screening means;

providing rotatable spray means below said screening means for said directing of a plurality of steams of fluid against said screening means; and providing said rotatable spray means with at least one drum rotatable about a horizontal axis and a plurality of spray nozzles arranged on the circumference thereof and directed at an acute angle from the radii of the drum to provide impulse for rotation of said drum and for said spraying of said underside of said screening means.

* * * * *

Disclaimer 5,992,641B1—Ronald W. Caldwell, Jr., Milledgeville, Ga. METHODS AND APPARATUS FOR SCREENING PARTICULATE MATERIALS. Patent dated November 30, 1999. Disclaimer filed February 22, 2000, by the assignee, Imerys Pigments, Inc.

Hereby enters this disclaimer to claims 1-38, of said patent.

*(Official Gazette, July 31, 2001)*